US005355902A

United States Patent [19]

Schlangen

[11] Patent Number: 5,355,902

[45] Date of Patent: Oct. 18, 1994

[54] UMBRELLA WITH SPHERICAL MECHANISMS

[75] Inventor: Karen S. Schlangen, LaCrescent, Minn.

[73] Assignee: Regents of the University of Minnesota, Minneapolis, Minn.

[21] Appl. No.: 78,444

[22] Filed: Jun. 16, 1993

[51] Int. Cl.[5] ..... A45B 11/00

[52] U.S. Cl. ..... 135/20.1; 135/20.3; 135/22

[58] Field of Search ..... 135/15.1, 20.1 DR, 20.3, 135/21, 22

[56] References Cited

U.S. PATENT DOCUMENTS

| | | | |
|---|---|---|---|
| 2,605,778 | 8/1952 | Clapper | 135/20.1 |
| 4,312,371 | 1/1982 | Koon | 135/20.1 |
| 4,347,862 | 9/1982 | Secon | 135/20.1 |
| 4,360,035 | 11/1982 | Dillman | 135/20.1 |
| 4,658,843 | 4/1987 | Raymond | 135/20.1 |
| 4,815,784 | 3/1989 | Zheng . | |

OTHER PUBLICATIONS

C. H. Chiang, "Kinematics of Spherical Mechanism", pp. 248–251 and 350–352, Cambridge University Press 1988.

Thesis by Karen S. Schlangen, "Spherical Mechanisms: Conception Through Construction", pp. 1–50.

"Spherical trigonometry", *Kinematics of Spherical Mechanisms* by C. H. Chiang, Published by Cambridge University Press in 1988, pp. 350–352.

"Dimensional syntheses—function generation problems", *Kinematics of Spherical Mechanism* by C. H. Chiang, Published by Cambridge University Press in 1988, pp. 248–251.

*Primary Examiner*—Carl D. Friedman
*Assistant Examiner*—Wynn E. Wood
*Attorney, Agent, or Firm*—Westman, Champlin & Kelly

[57] ABSTRACT

An umbrella comprises a collapsible cover portion and a flexible loop member attached to the cover portion. A linkage mechanism attached to the flexible loop member at first, second and third equidistantly spaced points moves the first, second and third points together such that the loop member is folded onto itself to form a plurality of smaller overlapping loops when the umbrella is in a closed position, and moves the first, second and third points away from each other such that the overlapping loops expand when the umbrella is in an opened position.

17 Claims, 6 Drawing Sheets

UMBRELLA WITH SPHERICAL MECHANISMS

BACKGROUND OF THE INVENTION

The present invention relates generally to an umbrella, and more particularly, to an umbrella which uses spherical mechanisms for opening and closing.

The umbrella or parasol dates back to at least 1350 B.C. and was originally designed for protection against the sun rather than rain. Today, although there is no structural or operational difference between the two, the term "umbrella" is used to designate an apparatus which provides protection from rain and snow, while the term "parasol" is used to designate an apparatus which provides sun protection. Several design characteristics of the umbrella have not changed since its creation. The umbrella has always maintained a dome shape with a pole in the middle which operates as a handle and actuator. Also, through most of its history, the umbrella has utilized a plurality of equidistantly spaced, identical four-bar planar mechanisms operated simultaneously by a single slider on the central handle for opening and closing the umbrella. In recent decades, more complex six and eight-bar planar mechanisms have replaced the historic four-bar mechanisms, allowing for more compact folding, though still folding by activation of a single slider on the central handle.

In general, the umbrella's planar mechanisms have complex mechanical linkages including ribs which extend along a plurality of equidistantly spaced radii from the central pole to the rim of the umbrella dome in the form a "spider-web" to support the umbrella dome. The use of planar mechanisms for opening and closing the umbrella has several disadvantages. One disadvantage is that since maximum protection from the elements is clearly beneath the center of the umbrella dome and since this space is occupied by the central pole, the umbrella user must always stand to one side of this pole and therefore never receives optimal protection. Another disadvantage is that since the four-bar planar linkages or mechanisms are designed to be small and compact near the umbrella's apex in order to maximize the head room under the umbrella, there must be long extensions to the umbrella rim for supporting the umbrella dome. These long extensions are weak and flexible and often permit the umbrella dome to flip inside-out when a gust of wind comes from up underneath the umbrella. A further disadvantage is that the stitching between ends of the individual ribs and the cover often becomes undone since the edges of the umbrella are held in place at eight stress points corresponding to ends of the ribs of each four, six or eight-bar planar mechanism.

SUMMARY OF THE INVENTION

The present invention relates to an umbrella comprising a collapsible cover portion, and a flexible loop member attached to and for supporting the cover portion. A linkage mechanism attached to the flexible loop member at first, second, and third equidistantly spaced points moves the first, second and third points together such that the flexible loop member is folded onto itself to form a plurality of smaller overlapping loops when the umbrella is in a closed position, and moves the first, second and third points away from each other such that the overlapping loops expand when the umbrella is in an opened position.

In one embodiment, the cover portion lies on a sphere and the linkage mechanism includes a spherical linkage positioned on the sphere when the umbrella is in the opened position and operable on the sphere to close the umbrella such that when the umbrella is closed, the spherical linkage and overlapping loops lie in a plane. A first spherical linkage is attached to the flexible loop member between the first and third points for moving the first point to the third point and a second spherical linkage is attached to the flexible loop member between the second and third points for moving the second point to the third point, such that by moving the first and second points to the third point, the loop member is folded onto itself for closing the umbrella. Upon moving the first and second points away from the third point, the umbrella is opened.

A handle is attached to the linkage mechanism at the periphery of the umbrella dome so it is to one side of the dome for allowing maximum space for protection from the elements under the umbrella dome.

DETAILED DESCRIPTION OF THE PREFERRED EMBODIMENTS

Figure 1:
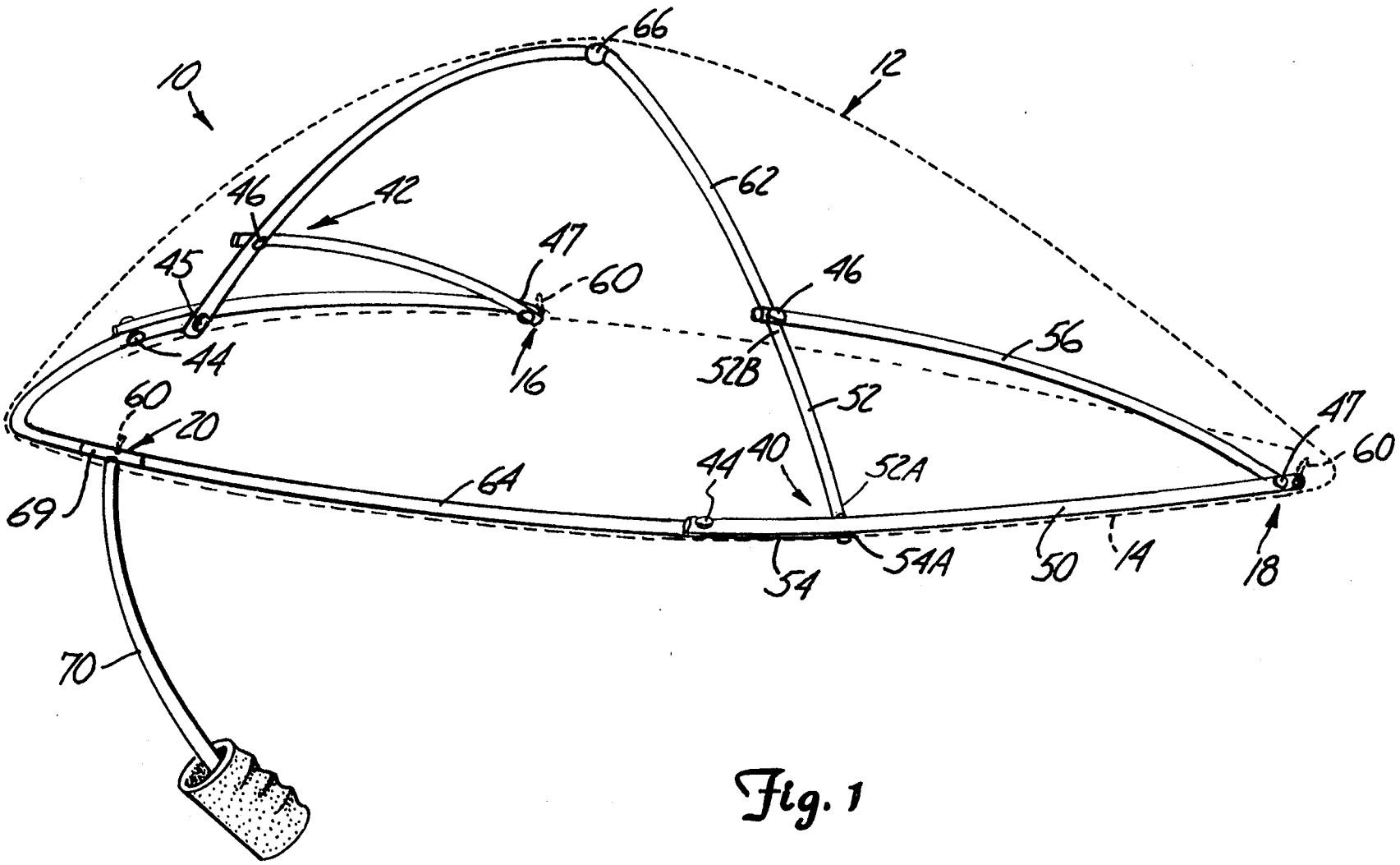
FIG. 1 is a perspective view of an umbrella of the present invention in an open position.

Referring to FIG. 1, an umbrella, generally indicated at 10, includes a collapsible dome or cover portion 12, a flexible loop member 14, preferably a flexible steel strip or wire attached to the cover portion 12, and a linkage mechanism 13 attached to the flexible loop member 14 at first, second, and third equidistantly spaced points 16, 18 and 20, respectively, for expanding cover portion 12 from a collapsed position to an open position, and for supporting the cover portion 12 in the open position.

The cover portion 12 is made of a soft flexible fabric, preferably nylon, and is shaped to form a dome which corresponds to a top portion of a sphere 21 (see FIG. 4) to protect a user from the natural elements. The term fabric is to be given its broadest meaning and may include woven fabrics, sheet fabrics, or even films.

Referring to FIGS. 1, 4 and 5A–5C, the flexible loop member 14 is preferably attached to the cover portion 12 along the entire circumference of the loop member 14 by mechanical fastening such as stitching or by fusing or gluing. The loop member 14 is equivalent to a line of latitude 23 on the sphere 21 and the cover portion 12 would be the top portion of the northern hemisphere of the sphere 21. The loop member 14 provides the structural shape of the umbrella 10 in the open position and the preferred flexible steel strip permits the loop member to fold onto itself to form three overlapping loops and which has a biasing force for expanding the loop member back to its original loop shape. The flexible loop member 14 is illustrated in the shape of a circular ring. However, other shapes such as an ellipse may be used. The ends of the flexible steel loop member 14 are held together by a retaining clip (not shown). Other materials, such as plastics, may be used in place of steel to form the loop member 14.

The flexible loop member 14 is supported on pivoting links of the linkage or mechanism frame 13 as will be explained, so that it folds onto itself to form three overlapping loops by moving together the first, second and third equidistantly spaced points 16, 18 and 20. The three points 16, 18 and 20 can be moved together at any point in space, however, it is preferred that the first and second points 16 and 18 be moved to the third point 20 in order to eliminate any linkages extending into the center of the cover portion 12. The flexible loop member can be folded to form any number of overlapping loops, however, it is most desirable to have three overlapping loops for stability and design reasons.

Figure 5C:
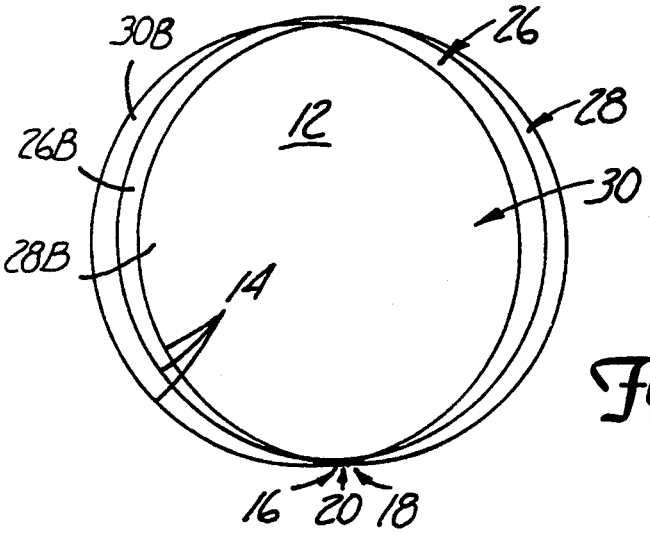
FIGS. 5A–5C are top plan views of the umbrella illustrating how the cover portion is closed.
Figure 5A:
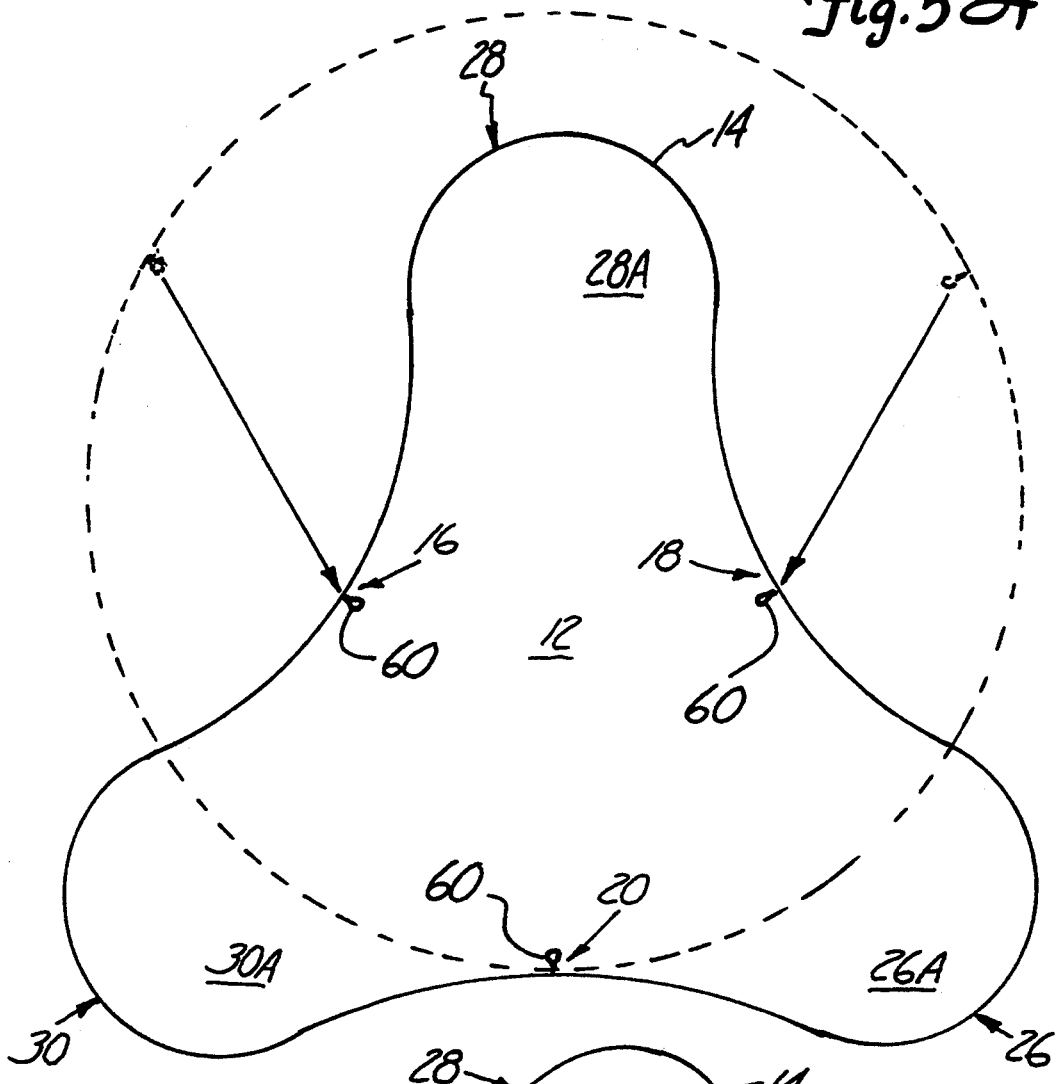
Figure 5B:
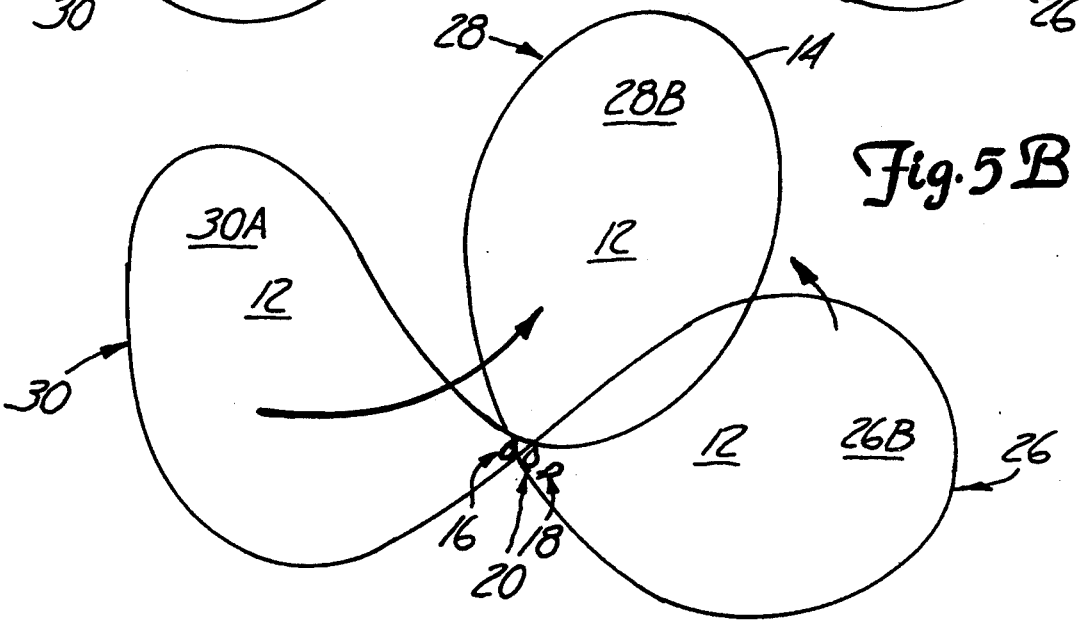

FIGS. 5A–5C illustrate the various stages of collapsing the cover portion 12 to close the umbrella 10 without the linkage mechanism 13 for clarity. FIG. 5A shows a first stage in which the first and second points 16 and 18 are drawn towards the third point 20 thereby forming a center loop 26, an inner loop 28 and an outer loop 30. The center loop 26 is formed between the second and third points 18 and 20 and has a top surface 26A and a bottom surface 26B. The inner loop 28 is formed between the first and second points 16 and 18 and has a top surface 28A and a bottom surface 28B. The outer loop 30 is formed between the first and second points 16 and 18 and has a top surface 30A and a bottom surface 30B. The relative positioning of the center, inner and outer loops 26, 28 and 30 with respect to each other may be varied and is not intended to limit the present invention.

Figure 3A:
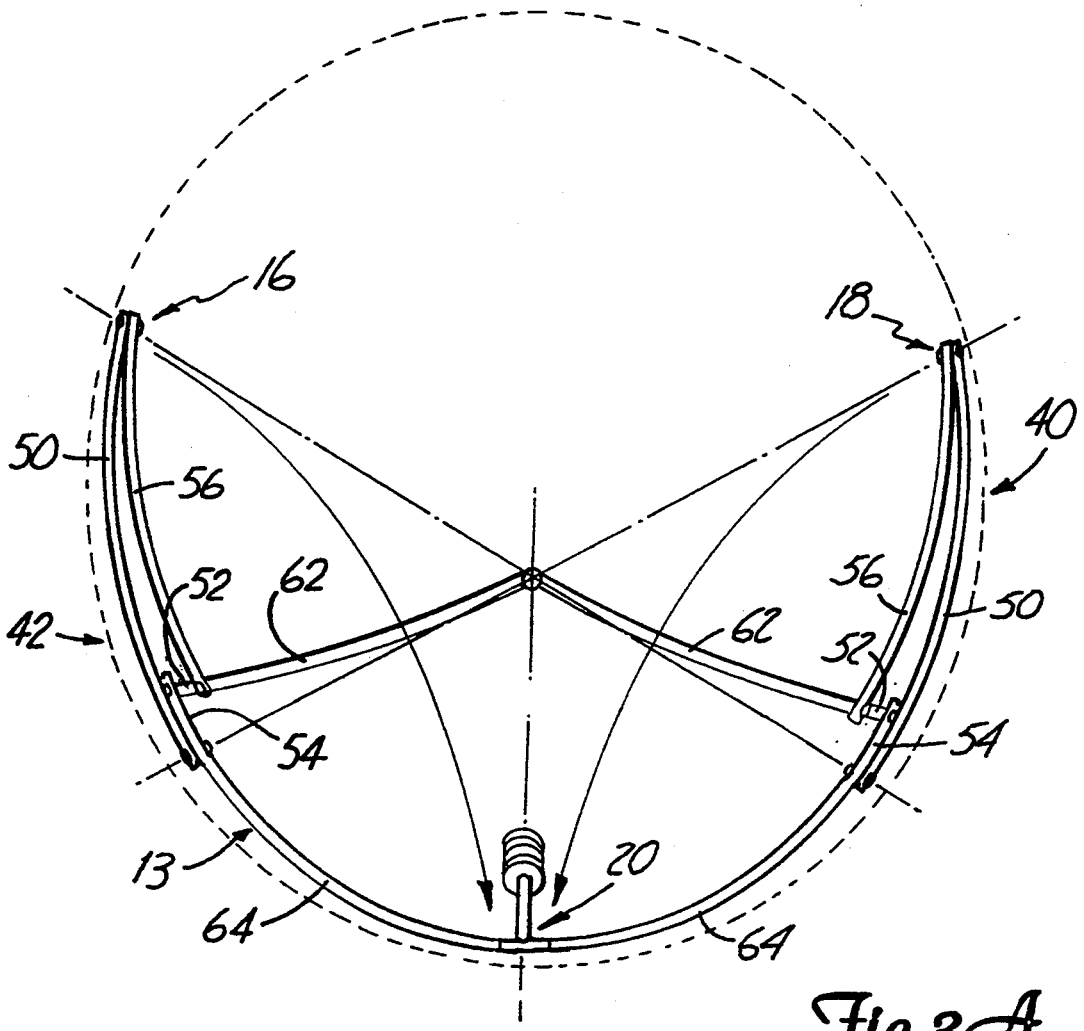
FIGS. 3A–3C are perspective views taken from the top of the umbrella illustrating the movement of the spherical linkage.
Figure 3B:
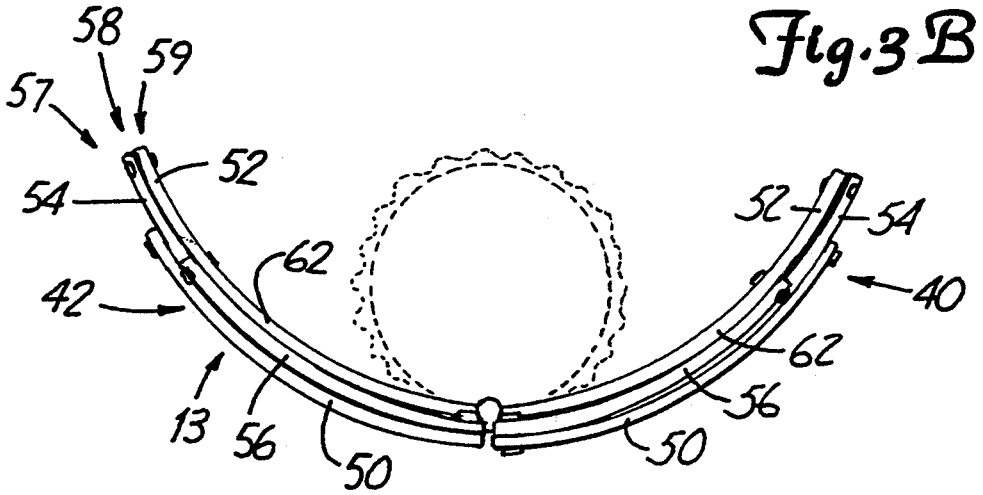
Figure 3C:
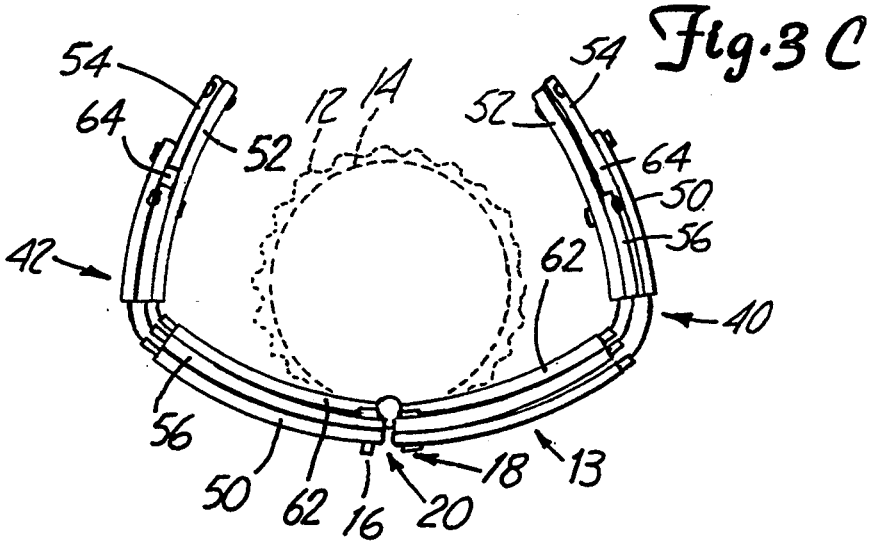

FIG. 5B shows a second stage as the first and second points 16 and 18 continue to be drawn towards the third point 20. As this happens, the center loop 26 flips over 180 degrees and the inner loop 28 flip over 180 degrees and the flexible loop member 14 and cover portion 12 collapse on top of themselves. FIG. 5C shows the fully collapsed cover portion 12 having three overlapping loops 26, 28 and 30 stacked on top of each other and occupying a fraction of the space of the open umbrella 10. In this closed position the outer loop 30 has also flipped over 180 degrees and the top surface 26A is positioned adjacent the bottom surface 28B and the top bottom surface 26B is adjacent the top surface 30A. FIG. 3C illustrates the umbrella 10 in the closed position and shows the relationship between the linkage mechanism 13 and the three overlapping loops 26, 28 and 30.

Figure 4:
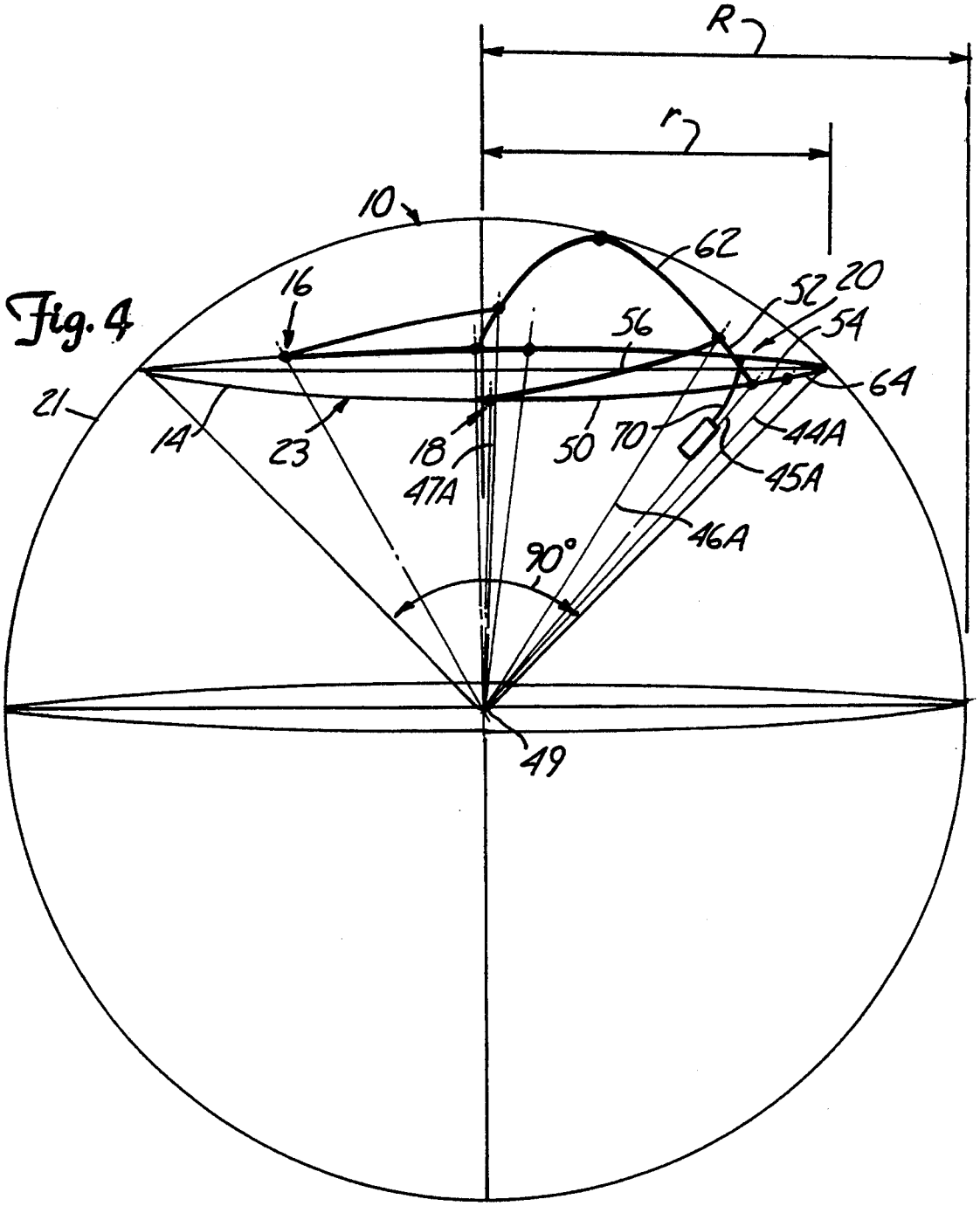
FIG. 4 is a diagram of a sphere showing an umbrella portion.

Referring to FIGS. 2–4, the linkage mechanism 13 may be of any construction, including a planar bar linkage, provided the linkage moves the first 16, second 18 and third 20 points together. However, the linkage mechanism 13 preferably includes a first spherical linkage 40 and a second of spherical linkage 42 which are mirror images of each other and positioned on the outer surface of the sphere 21 in which the cover portion 12 partially lies when the umbrella 10 is in the open position. When the umbrella 10 is closed, the first and second spherical linkages 40 and 42 and overlapping loops 26, 28 and 30 lie substantially in a single plane limited only by the tolerances of the linkage members. The first and second spherical linkages 40 and 42 provide support and shape for the cover portion in the open position and are foldable into the closed position for convenient and compact storage of the umbrella 10. The first spherical linkage 40 is attached to the flexible loop member 14 at the first and third points 16 and 20 to permit moving the first point 16 to the third point 20 and the second spherical linkage 42 is attached to the flexible loop member 14 at the second and third points 18 and 20 to permit moving the second point 18 to the third point 20, such that by moving the first and second points 16 and 18 to the third point 20, the flexible loop member 14 folds up onto itself as described above as the spherical linkages are folded by pivoting individual links.

Referring specifically to FIG. 4, each spherical linkage 40 and 42 is a four-bar mechanism with four revolute or pin joints 44, 45, 46 and 47 on four separate rotational axes 44A, 45A, 46A and 47A. Each spherical linkage 40 and 42 operates on the outer surface of the sphere 21 and the four rotational axes 44A, 45A, 46A and 47A intersect at the center 49 of the sphere 21 on which the spherical linkages 40 and 42 operate.

Referring again to FIGS. 2–4, each four-bar mechanisms comprising the respective spherical linkage 40 and 42 includes an output crank 50, an input crank 52, a fixed link 54 and a moving link 56. It is desirable for the input crank 52 to be perpendicular to the output crank 50 when the umbrella 10 is in the open position and approximately co-planar with the output crank 50 when the umbrella 10 is in the closed position. Thus, each spherical linkage 40 and 42 is a spherical function generators in which a 90° rotation of the input crank 52 produces a 180° rotation of the output crank 50. Since spherical function generator are well known to those skilled in the art, the theory and mathematics will not be described herein. Instead, reference is made to *Kinematics of Spherical Mechanisms* by C. H. Chiang, Cambridge University Press, Cambridge, England, 1988 and *Spherical Mechanisms: Conception Through Construction,* by Karen Schlangen, Honors Thesis B.S.M.E. University of Minnesota, 1992 which provides the mathematical equations and the general background and support for the operation and design of spherical mechanisms and which are incorporated herein by reference.

The output crank 50, the input crank 52, the fixed link 54 and the moving link 56 are connected to each other and arranged on three radial shells including an outer shell 57, a middle shell 58, and an inner shell 59. The number of radial shells and the positioning of a crank or link on a particular shell is shown and described in a preferred embodiment and is not intended to limit the present invention.

Figure 2A:
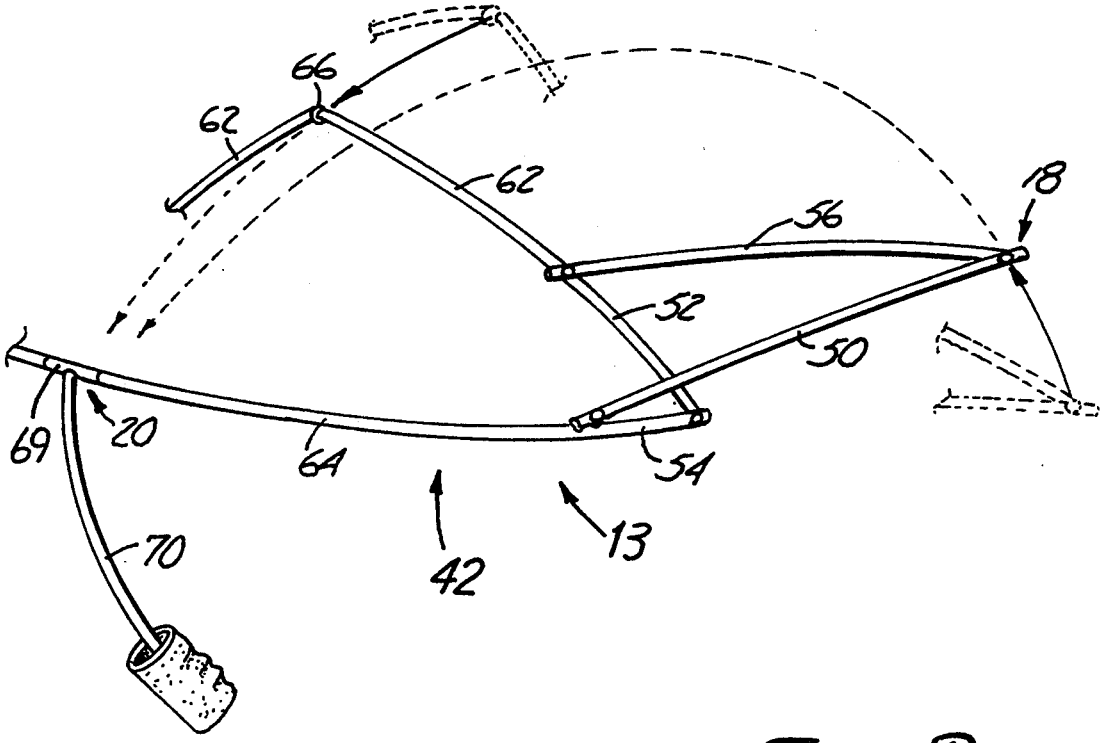
FIGS. 2A–2B are perspective views taken from the side of the umbrella illustrating the movement of a spherical linkage.
Figure 2B:
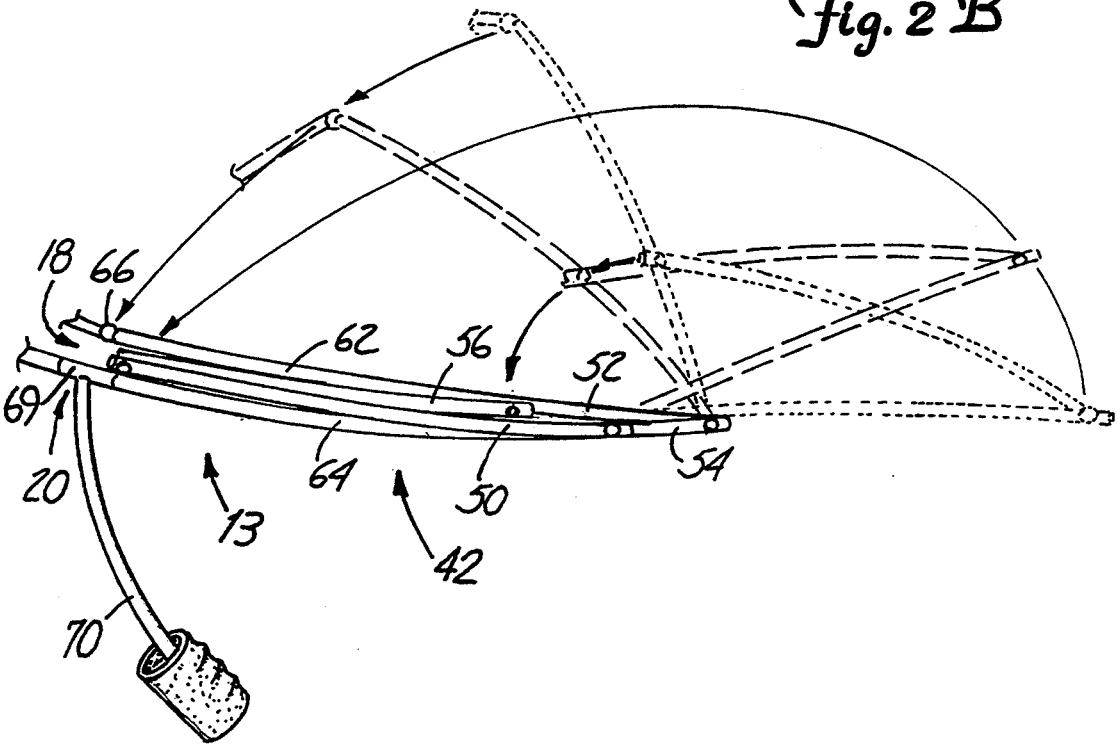

Each output crank 50 is positioned in the outer shell 57, adjacent the flexible loop member 14 on the surface of the sphere 21 and is attached to the first and second points 16 and 18 on the flexible loop member 14 by a swivel 60. The swivel 60 permits the flexible loop member 14 to flex and twist in order to fold onto itself. Referring specifically to FIGS. 2A–2B each output crank 50 is rotated 180° in order to get the first and second points 16 and 18 to the third point 20 and so that each output crank 50 is horizontal in both the open and closed positions. Since the first and second points 16 and 18 on the loop member each have to move 120° along the circumference of the flexible loop member 14 to the third point 20 and since the output crank 50 is rotated 180°0 across the surface of the sphere 21, the arcuate length of the output crank 50 is preferably the equivalent of 60° or 1/6 of the circumference of the flexible loop member 14.

Each input crank 52 is positioned on the inner shell 59 and is perpendicular to the output crank 50 and fixed link 54 of the respective spherical linkage 40 and 42.

Each input crank 52 has an outer end 52A attached to the respective fixed link 54 and an inner end 52B attached to the respective moving link 56. The arcuate length of the input crank 52 is greater than the arcuate length of the fixed link 54 in order to permit the linkage mechanism 13 to lie substantially in a single plane, limited only by the tolerance of the linkages, when the spherical mechanism is in the closed position. The arcuate length of the input crank 52 is determined mathematically either by spherical trigonometry or preferably by the known linkage relationship of a spherical function generator. See C. H. Chiang, *Kinematics of Spherical Mechanisms,* Cambridge University Press, Cambridge, England, pp. 248–251 and 350–352 (1988).

Each input crank 52 has an extension member which forms an extended input crank 62 which extends out from the inner end 52B of the input crank 52 up into the center of the cover portion 12 for supporting the cover portion 12. In order to have a single input operate both spherical linkages 40 and 42 simultaneously, the outer ends of the extended input cranks 62 are connected to each other at the top of the cover portion 12 using a ball joint or other universally pivoting member 66. The arcuate length of the extended input crank 62 is chosen as a design constraint on the sphere of radius R and is, for example, 45°.

Each fixed link 54 is positioned in the middle shell 58. Each fixed link 54 has an outer end 54A attached to the input crank 52 and an inner end 54B attached to the output crank 50. Each fixed link 54 has an extension member extending out from the inner end 54B forming an extended fixed link 64. The extended fixed links 64 are attached to each other and to the first point 16 on the loop member 14 for providing a fixed base around which the spherical linkages 40 and 42 operate. The fixed links 54 and extension members 64 provide support for both spherical linkages 40 and 42. The arcuate length of the fixed link 54 is equal to the arcuate length of the extended input crank 62 less arcuate length of the output crank 50.

Each moving link 56 is positioned on the middle shell 58 and connects the input crank 52 to the output crank 50 for moving the output crank 50 from the open position to the closed position. The arcuate length of the moving link 56 equals the arcuate length of extended input crank 62 less arcuate length of input crank 52. In the closed position, both spherical linkages 40 and 42 lie substantially in a single plane and so the arcuate length of the input crank 52 plus the arcuate length of the moving link 56 equals the arcuate length of the fixed link 54 plus the arcuate length of the output crank 50. The following constraints are also important in determining the configuration of the spherical linkages 40 and 42. The arcuate length of the moving link 56 is greater than the arcuate length of the output crank 50 less the arcuate length of the fixed link 54. The arcuate length of the moving link 56 is greater than the arcuate length of the input crank 52 by definition, since the moving link 56 is the hypotenuse of a right triangle formed between the output crank 50, input crank 52 and moving link 56.

Referring again to FIG. 4, the cover portion 12 of the umbrella 10 is equivalent to the top portion of the northern hemisphere of the sphere 21 and the loop member 14 is equivalent to the line of latitude 23. Thus, the umbrella 10 has a circular radius r, whereas the sphere 21 on which the umbrella lies has a radius of R. Since the spherical linkages 40 and 42 operate on the surface of the sphere 21 of radius R, spherical geometry must be used to determine the arcuate and cord lengths of the linkages on the sphere 21 in order to get the desired motion on the umbrella 10 having a radius r. The arcuate and chord lengths of the spherical linkages are determined for both the umbrella 10 and the sphere 21 by well known trigonometric formulas.

Referring to FIG. 3C, the input crank extensions 62, fixed link extensions 64, moving links 56 and output cranks 50 each have a two-part mateable construction enabling the links and cranks to be separated, and folded up more compactly on top of themselves and onto of the overlapping loops 26, 28 and 30. Elastic cords may be used to hold the two-part constructions together. A hinge 69 connects the outer end of each extended fixed link 64 to each other such that the output cranks 50, input cranks 52, fixed links 54 and moving links 56 can be folded over onto the overlapping loops 26, 28 and 30 when the umbrella 10 is in the closed position for compact storage of the umbrella 10.

A handle 70 is attached to the linkage mechanism 13 at the hinge 69 intersection of the extended fixed links 64 along the circumference of the umbrella dome to permit the umbrella user to stand under the center of the cover portion 12 thereby allowing maximum protection from the elements. Preferably the handle 70 is angled inward and adjustable such that the user can move the handle 70 to a desired position.

In operation, the umbrella 10 is closed by moving the extended input cranks 62 to the third point 20 on the loop member 14. As shown in FIGS. 2A–2B and 3A–3C the output crank 50 of each spherical linkage 42 and 44 rotates 180° while traveling 120° along the umbrella 10 circumferences bringing the first and second points 16 and 18 to the third point 20. As shown in FIG. 5A–5C, as the first, second and third points 16, 18 and 20 converge, the loop member 14 and cover portion 12 fold on top of themselves forming the center, inner and outer 26, 28 and 30 connections loops. Since the spherical linkages 42 and 44 operate on the outer surface of the umbrella sphere 21 there is significantly more head room under the umbrella dome compared to conventional umbrellas, which operate using planar mechanisms. Also, the handle is positioned on the outer periphery of the umbrella and the complex 8-bar planar mechanisms are replaced by a more eloquent solution, utilizing spherical mechanisms.

Although the present invention has been described with reference to preferred embodiments using spherical mechanisms, workers skilled in the art will recognize that changes may be made in form and detail without departing from the spirit and scope of the invention.

What is claimed is:

1. An umbrella comprising:

a collapsible cover portion;

a flexible loop member attached to the cover portion; and linkage means attached to the flexible loop member at first, second, and third equidistantly spaced points for moving the first, second and third points together such that the flexible loop member folds onto itself to form a plurality of smaller overlapping loops when the umbrella is in a closed position and for moving the first, second, and third points away from each other such that the overlapping loops expand when the umbrella is in an open position.

2. The umbrella as in claim 1, wherein the cover portion lies on a sphere and wherein the linkage means includes first and second spherical linkages positioned on the sphere when the umbrella is in the open position and operable on the sphere to close the umbrella.

3. The umbrella as in claim 2, wherein the linkage means comprises a first spherical linkage is attached to the flexible loop member between the first and third points for moving the first point to the third point and a second spherical linkage is attached to the flexible loop member between the second and third points for moving the second point to the third point, such that by the moving the first and second points to the third point the loop member is folded onto itself to form the plurality of smaller overlapping loops wherein the umbrella is in a closed position and such that by moving the first and second points away from the third point the overlapping loops expand wherein the umbrella is in an open position.

4. The umbrella as in claim 3, wherein each spherical linkage is a four-bar mechanism having four rotational axis which intersect at the center of the sphere.

5. The umbrella as in claim 3, wherein each spherical linkage has an output crank having an arcuate length the equivalent of 60 degrees of the circumference of the flexible member.

6. The umbrella as in claim 4, wherein each four-bar mechanism has an input crank member operable over 90 degrees and an output crank members attached to the circular loop which rotates 180 degrees in response to the 90 degree rotation of the input crank member for opening and closing the umbrella.

7. The umbrella as in claim 6, wherein the input and output crank members are perpendicular to each other when the umbrella is in the open position.

8. The umbrella as in claim 5, wherein each spherical linkage further comprises a fixed linkage attached to the input crank, to the output crank, and to each other at the first point on the circular loop for providing a fixed base around which the spherical linkage operates.

9. The umbrella as in claim 8, further comprising a hinge connecting the fixed links to each other such that the spherical linkage assembly can be folded onto the overlapping loops when the umbrella is in the closed position for more compact storage.

10. The umbrella as in claim 4, wherein each four-bar mechanism includes an input crank, an output crank, a fixed link and a moving link, wherein the arcuate length of the input crank plus the arcuate length of the moving link equals the arcuate length of the fixed link plus the arcuate length of the output crank.

11. The umbrella as in claim 10, wherein each four-bar mechanism further includes an input crank extension extending up into the center of the cover portion for supporting the cover portion when the umbrella is in the open position and which operates to open and close the umbrella.

12. The umbrella as in claim 11, wherein each four-bar mechanism further includes a fixed link extension attached to each other and to the third point on the flexible loop member.

13. The umbrella as in claim 11, wherein the arcuate length of the fixed link equals the arcuate length of the input crank extension plus the arcuate length of the input crank less the arcuate length of the output crank.

14. The umbrella as in claim 1, further comprising a handle extending downward from linkage means when the umbrella is in the open position.

15. An umbrella comprising:

a collapsible cover portion;

a flexible loop member attached to the periphery of the cover portion for providing support and shape to the cover portion when the umbrella is in an open position and which provides a biasing force to expand the umbrella from a closed position to the open position; and means for collapsing the flexible loop member onto itself to form a plurality of overlapping loops when the umbrella is in the closed position.

16. The umbrella as in claim 15 wherein the cover portion lies on a sphere in the open position, and wherein the means for collapsing and expanding the flexible loop member includes a pair of spherical linkages attached to the flexible loop member at first, second and third points thereon for moving the first and second points to the third point such that the flexible loop member collapses onto itself forming the plurality of overlapping loops.

17. The umbrella as in claim 16, further comprising a handle attached to the means for collapsing the flexible loop member.

* * * * *